US007878339B2

(12) United States Patent
Steffens et al.

(10) Patent No.: US 7,878,339 B2
(45) Date of Patent: Feb. 1, 2011

(54) MERCHANDISE DISPLAY HOOK FOR FISHING RODS

(76) Inventors: Skip Steffens, 26 E. 337th Rd., Humansville, MO (US) 65674; Beverly Ann Steffens, 26 E. 337th Rd., Humansville, MO (US) 65674

( * ) Notice: Subject to any disclaimer, the term of this patent is extended or adjusted under 35 U.S.C. 154(b) by 1440 days.

(21) Appl. No.: 11/129,889

(22) Filed: May 16, 2005

(65) Prior Publication Data

US 2006/0254995 A1 Nov. 16, 2006

(51) Int. Cl.
*A47F 7/00* (2006.01)

(52) U.S. Cl. ..... 211/70.8

(58) Field of Classification Search ..... 211/70.8, 211/59.1, 57.1, 54.1, 181.1; D22/147; 248/87, 248/175, 156
See application file for complete search history.

(56) References Cited

U.S. PATENT DOCUMENTS

| | | | | | |
|---|---|---|---|---|---|
| 1,537,237 | A | * | 5/1925 | Kaestner | 248/87 |
| 1,876,478 | A | | 12/1930 | Duzer | |
| 2,137,645 | A | * | 11/1938 | Doench | 43/21.2 |
| 2,519,612 | A | * | 8/1950 | Tuttle | 248/530 |
| 2,574,441 | A | * | 11/1951 | Stewart | 248/87 |
| 2,751,174 | A | * | 6/1956 | Parker | 248/513 |
| 2,773,603 | A | * | 12/1956 | Gronek | 211/1 |
| D179,586 | S | * | 1/1957 | Wise | D22/147 |
| 2,888,220 | A | * | 5/1959 | Rose | 248/538 |
| D187,276 | S | * | 2/1960 | Poglein | D22/147 |
| D205,289 | S | * | 7/1966 | Ring et al. | D22/147 |
| D228,901 | S | * | 10/1973 | Gallaway | D22/147 |
| D231,925 | S | * | 6/1974 | Speigel | D22/147 |
| 3,956,846 | A | * | 5/1976 | Kent | 43/21.2 |
| 3,995,742 | A | | 12/1976 | Austin et al. | 211/60 |
| 4,025,018 | A | | 5/1977 | Thalenfield | 248/303 |
| D245,423 | S | * | 8/1977 | Tentler | D22/147 |
| 4,162,015 | A | | 7/1979 | Hodges | 211/87 |
| D260,114 | S | * | 8/1981 | Cecchetti | D22/147 |
| 4,516,682 | A | * | 5/1985 | Bell | 211/59.1 |
| 4,560,071 | A | * | 12/1985 | Downing et al. | 211/70.8 |
| 4,732,280 | A | * | 3/1988 | Nieders | 211/85.7 |
| D306,681 | S | * | 3/1990 | Toca, III | D8/1 |
| D315,012 | S | * | 2/1991 | Koga | D22/147 |
| 5,035,388 | A | | 7/1991 | Nagel | 248/220.4 |

(Continued)

OTHER PUBLICATIONS

Requisition by the Examiner (in Canada). Appln. No. CA 2,545,955 Date of Mailing; May 23, 2008.

*Primary Examiner*—Sarah Purol
(74) *Attorney, Agent, or Firm*—Jonathan A. Bay

(57) ABSTRACT

A merchandise display hook for fishing rods has an elongated shaft originating in a hanger fixture for hanging or arranging on a vertical support surface and extends from there to a terminal end formed or affixed with hook formation for carrying a fore section of rod handle. The display hook includes a retainer attached to the shaft in between the hanger fixture and hook formation for retaining a section of the rod handle that is in between the fore section and the rod's butt end. The shaft is arranged to project from the hanger fixture generally horizontally. The hook formation and retainer are cooperatively arranged to cantilever the fishing rod in a suspended projecting disposition. Preferably the hook is hung about head high or higher. A row of such display hooks carrying a procession of fishing rods forms sort of a picket canopy in a retail setting over aisles.

17 Claims, 7 Drawing Sheets

U.S. PATENT DOCUMENTS

| | | | | | |
|---|---|---|---|---|---|
| 5,152,494 | A | | 10/1992 | Frunzar | 248/513 |
| 5,184,797 | A | * | 2/1993 | Hurner | 248/538 |
| D343,441 | S | * | 1/1994 | Peacock | D22/147 |
| D345,409 | S | * | 3/1994 | Baynard | D22/147 |
| 5,313,734 | A | * | 5/1994 | Roberts | 43/21.2 |
| 5,321,904 | A | * | 6/1994 | Benson | 43/21.2 |
| D394,300 | S | * | 5/1998 | Samuels et al. | D22/148 |
| 5,845,891 | A | | 12/1998 | West | 248/538 |
| D422,890 | S | | 4/2000 | Foster | D8/372 |
| D447,213 | S | * | 8/2001 | Rossman | D22/147 |
| D455,472 | S | * | 4/2002 | Rossman | D22/147 |
| D471,952 | S | * | 3/2003 | Cardenas | D22/147 |
| 6,561,362 | B1 | * | 5/2003 | Cummins | 211/49.1 |
| D480,781 | S | * | 10/2003 | Pastor | D22/147 |
| D489,118 | S | * | 4/2004 | Preiss | D22/147 |
| 6,837,384 | B2 | | 1/2005 | Secondino | 211/87.01 |

* cited by examiner

MERCHANDISE DISPLAY HOOK FOR FISHING RODS

BACKGROUND AND SUMMARY OF THE INVENTION

The invention relates to support racks and, more particularly, to a merchandise display hook for fishing rods.

It is an object of the invention to provide retailers with an overhead presentation or display of fishing rods that is not only alluring to shoppers for being up high but also appealing to retailers for freeing up floor space.

It is an alternate object of the invention to provide a display hook that projects out from a hanger base that hung about head high and accordingly projects the rod out by supporting the butt end thereof (ie., it cantilevers the rod out by supporting the butt end).

It is a further object of the invention to create a row or rows of such projected rods to form sort of a picket canopy.

It is another object of the invention to closely space such display hooks in order to showcase large number of rods over a limited horizontal run of pegboard or like vertical support structure on which to hang or arrange the hooks.

It an additional object of the invention that the picket canopy of rods incline at a slight upward angle overhead standing shoppers so that the tip ends are not a hazard to passers-by while also allowing shoppers opportunity to walk in close underneath the butt ends and perform close inspection thereof (eg., the butt ends are commonly assumed to be of keen interest to shoppers).

A number of additional features and objects will be apparent in connection with the following discussion of the preferred embodiments and examples with reference to the drawings.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the skills of a person having ordinary skill in the art to which the invention pertains. In the drawings.

DETAILED DESCRIPTION OF THE PREFERRED EMBODIMENTS

Figure 1:
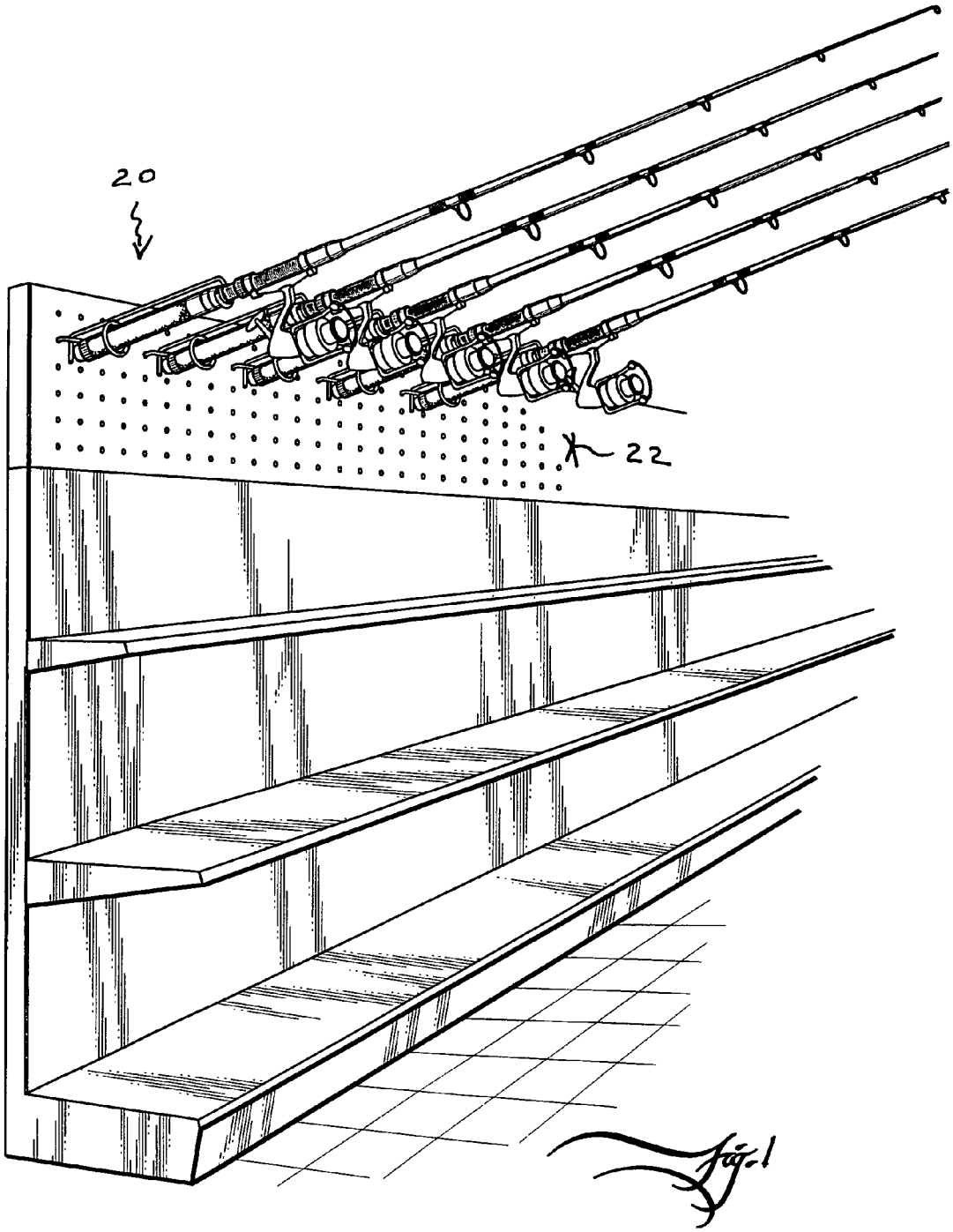
FIG. 1 is a perspective view of a row of like merchandise display hooks in accordance with the invention for supporting fishing rods in a retail setting, wherein the fishing rods are arranged to form an elevated, upwardly-inclined picket canopy not only above shelves or displays for other merchandise at lower elevations, but also above aisle space.

FIG. 1 shows an elevated row of merchandise display hooks 20 in accordance with the invention for hanging or arranging on a vertical support structure and then supporting fishing rods by the butt ends thereof for projecting out the tip ends as shown. Whereas this description shows pegboard panels 22 as an example vertical support structure on which to hang or arrange the display hooks 20 in accordance with the invention, this is done so for convenience only. Persons having ordinary skill would readily recognize how to re-construct the display hook 20's hanger 26 in order to have the display hook 20 satisfactorily hanging from or mounted to other types of vertical support structure, including plain walls or else tracks and the like, including what is disclosed by U.S. Pat. No. 6,837,384, entitled "Storage Track," the disclosure of which is incorporated by reference.

Hence the display hook 20 in accordance with the invention hangs from (eg.) pegboard 22 (or else a like vertical structure on which to hang or arrange the display hook 20) about head high and projects the rod out by the butt end thereof. In other words, the display hook 20 cantilevers the rod by the butt end. Arranging a row of such display hooks 20 projects a series of rods in a sideways procession such as to form sort of a picket canopy. It is an aspect of the invention that the display hooks 20 allow close side-by-side spacing in order to showcase large number of rods over a limited horizontal run of the pegboard 22 (or, again, the like vertical structure on which to hang or arrange the display hooks 20).

Preferably the picket canopy of the rods incline upwardly as group overhead aisle space so that the tip ends are not hazards to passers-by. This also allows shoppers an opportunity to walk in close underneath the butt ends and perform a close inspection thereof. In the trade, the butt ends are commonly assumed to be of keen interest to shoppers. Moreover, elevating the display hooks 20 and rods as shown additionally allows use of lower shelf space or other types of display hooks (no other types of display hooks shown) for showcasing other merchandise below the picket canopy. Overall, this overhead presentation or display of fishing rods in accordance with the invention is not only alluring to shoppers for creating an aesthetic picket canopy but is also appealing to retailers for freeing up floor space.

Figure 2:
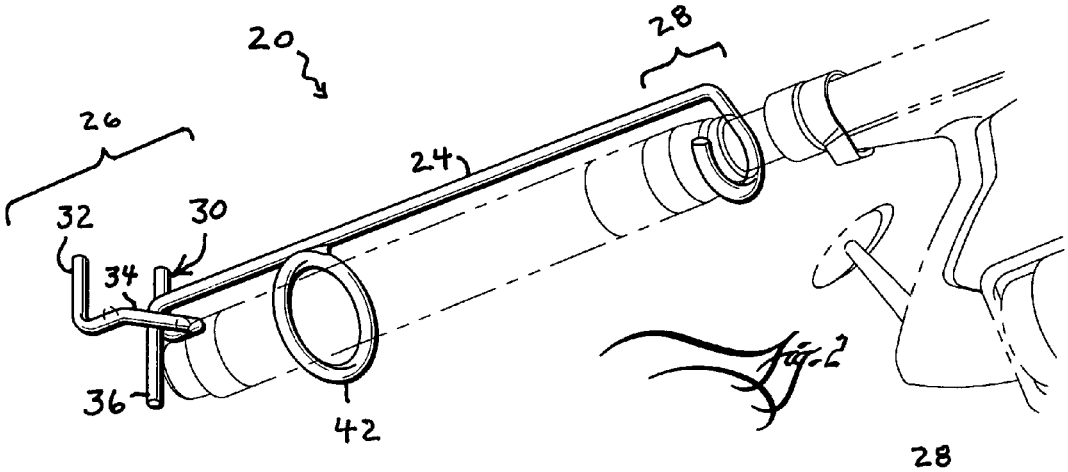
FIG. 2 is an enlarged-scale perspective view of one such merchandise display hook in FIG. 1, wherein a butt section of a fishing rod is shown in broken lines to illustrate operative use.
Figure 3:
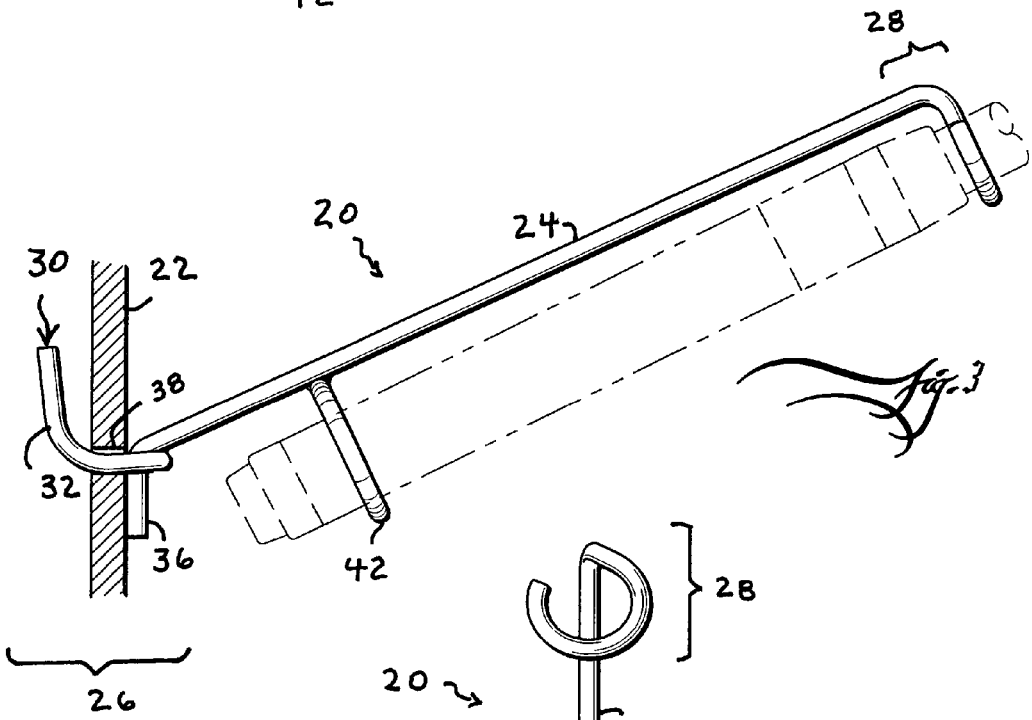
FIG. 3 is a side elevational view thereof, wherein a section of pegboard is shown in section lines to illustrate one non-limiting example of a vertical support structure on which to hang or arrange the hook.
Figure 4:
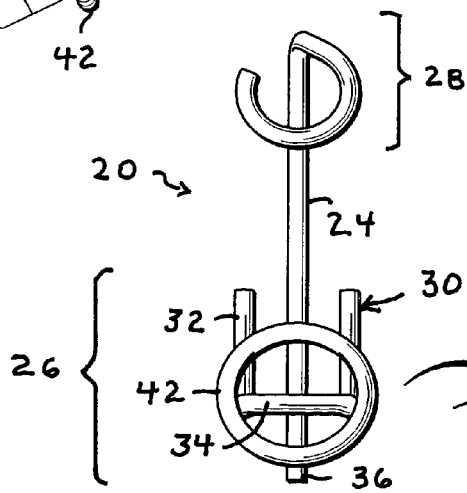
FIG. 4 is front elevational view thereof.

Referring to FIGS. 2 through 4, this embodiment of a display hook 20 is a product of metal rod construction. The display hook 20 has a main shaft section 24 extending between an origin formed with a hanger formation 26 and a termination formed with a hook formation 28. The hanger formation 26 comprises another metal rod construction 30 fused or welded with the main shaft section 24 to complete hanger formation 26. More particularly, this other metal rod construction 30 is essentially an L-shaped prong or, in other words, this L-shaped prong 30 has a pair of L-shaped pegs 32 that project squarely from a crosspiece 34. The main shaft section 24 originates (as, eg., in contrast to terminates as in the direction of the hook formation 28) in a transition from a downwardly depending stop section 36. The L-shaped prong 30 is fused to the transition between the main shaft section 24 and stop section 36 such that the crosspiece 34 is centered under the inside of the transition (eg., bend) therebetween. In use, FIG. 3 shows that the L-shaped pegs 32 insert from front through a pair of holes 38 in a pegboard panel 22 (only the near peg 32 and hole 38 are shown) and extend up behind the backside thereof. The pegs 32 provide vertical hanging strength. The depending stop section 36 rests against the front of the pegboard panel 22 and stops the display hook 20 from drooping down any further. Hence the depending stop section 36 props out the outward-projecting main shaft section 24.

The main shaft section 24's hook formation 28 is formed in an under-hanging arrangement as shown. The hook formation 28 forms an open loop in a plane that is generally transverse to the axis of the main shaft section 24. The main shaft section 24 also carries on it (at a position intermediate the hook and hanger formations 28 and 26, but closer to the hanger formation 26) a retaining ring 42 that is joined by welding or fusing and the like. Like the hook formation 28, the retaining ring 42 is also oriented in a plane that is generally transverse to the axis of the main shaft section 24.

FIG. 4 shows that the retaining ring 42 and hook formation 28 define bellies or "bights" that are preferably laterally symmetric about a vertical plane symmetry containing the axis of the main shaft section 24 that extends overhead. The "bight" of the hook formation 28 supports a fore-section of the rod handle as shown. In most instances, the rod's fore-section will rest on the hook formation 28's bight as if it should teeter thereon like teetering on a fulcrum. Depending on the center of gravity for the rod as a whole, the rod will have an aft-section of the handle situated in the retaining ring 42 in either one of two ways. That is, either the rod handle's aft section will rest in the retaining ring 42's undergirding bight or else be wedged up against the top of the ring 42 directly above the undergirding bight. The vertical symmetry mentioned above that exists among the hook formation 28, the retaining ring 42, and the main shaft section 24 promotes straighter projection of the rod out in the vertical plane containing the axis of the main shaft section 24. Presumptively the retaining ring 42 acts not only to keep the rod tip from teetering over down to the floor but also from swaying about off the vertical plane of symmetry.

Figure 5:
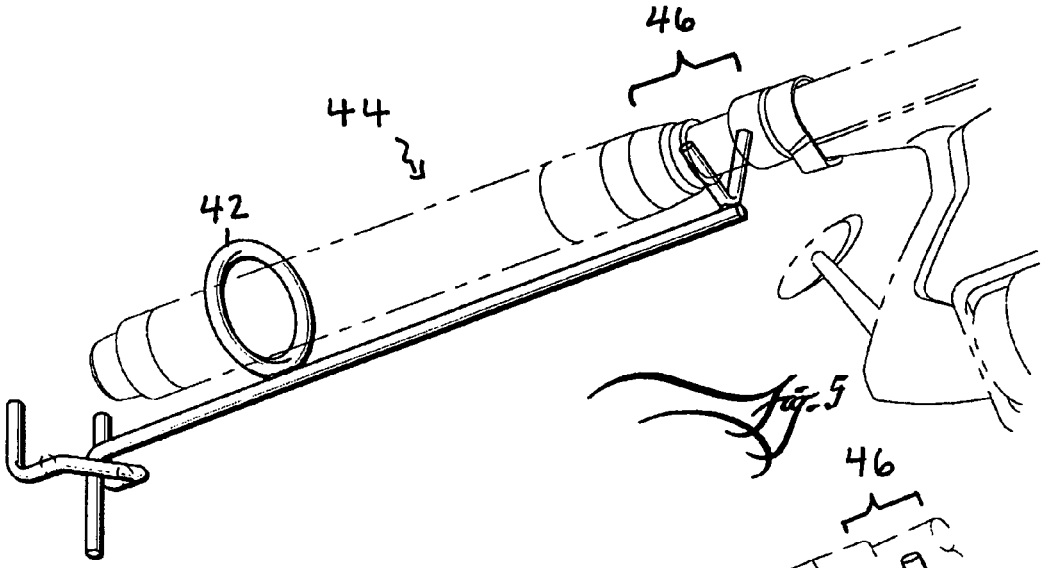
FIG. 5 is a perspective view comparable to FIG. 2 except showing an alternate embodiment of a merchandise display hook in accordance with the invention for fishing rods.
Figure 6:
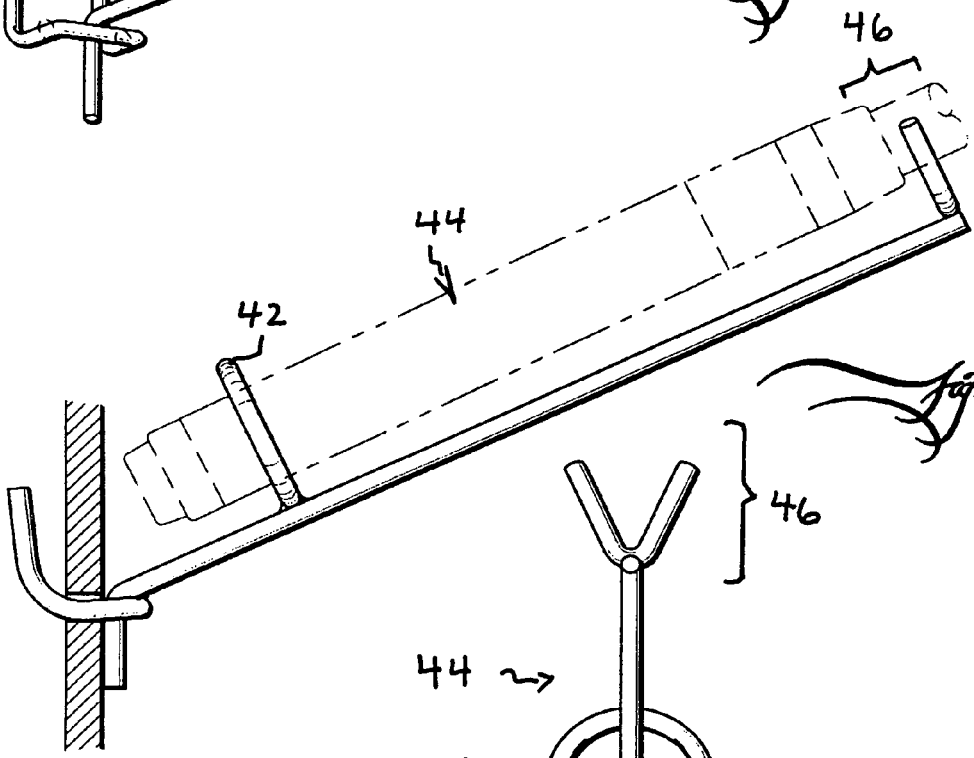
FIG. 6 is a side elevational view thereof.
Figure 7:
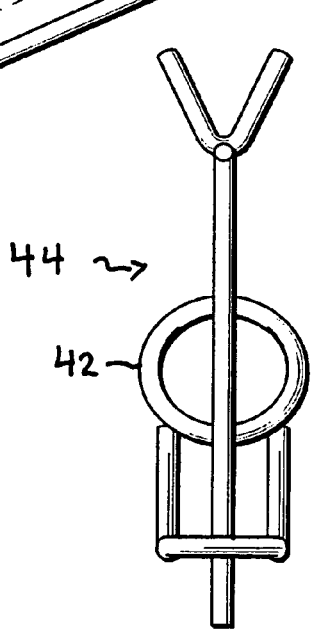
FIG. 7 is a front elevational view thereof.

FIGS. 5 through 7 show an alternate embodiment of the merchandise display hook 44 in accordance with the FIGS. 2 through 4. In FIGS. 5 through 7, this display hook 44 has a terminal end supporting an elevated V-shaped bight 46. The retaining ring 42 is fused or welded on top of the main shaft. Hence, rather suspending the rod underneath the main shaft, this display hook 44 projects the rod by carrying it above as shown.

Figure 8:
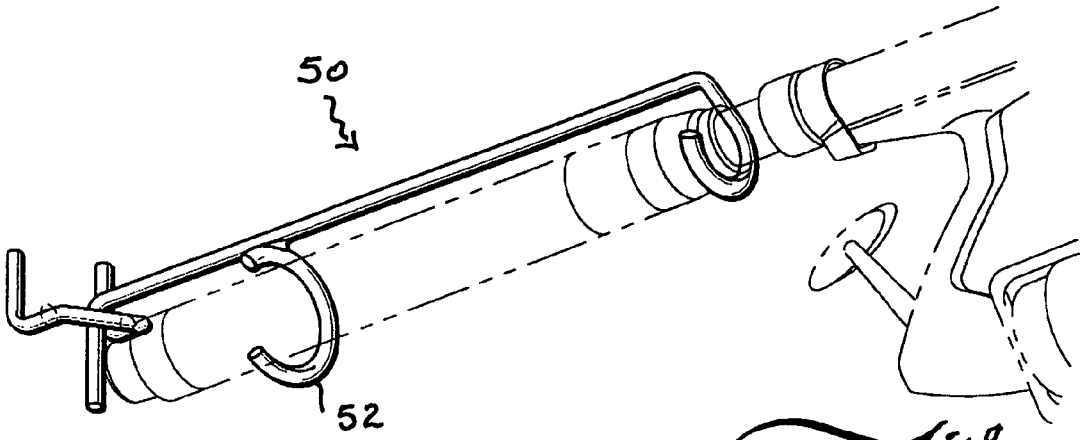
FIG. 8 is a perspective view comparable to FIG. 2 except showing an additional embodiment of a merchandise display hook in accordance with the invention for fishing rods.

FIG. 8 shows a display hook 50 comparable to FIG. 2 except the retaining ring 42 in FIG. 2 is replaced in this display hook with a C-shaped retainer 52 that has an open loop having a C-shape.

Figure 9:
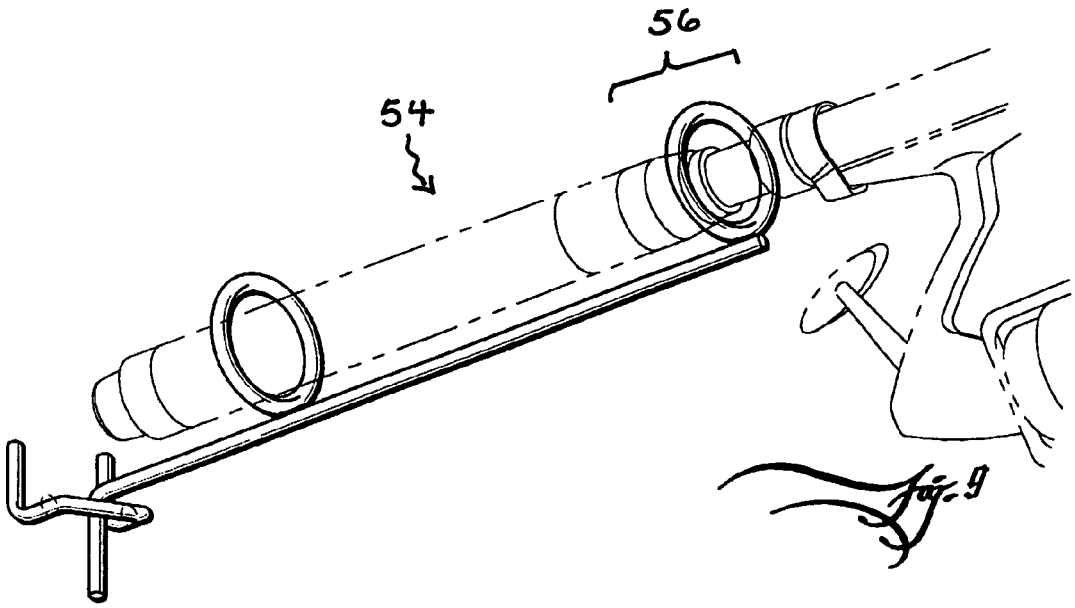
FIG. 9 is a perspective view comparable to FIG. 2 or 5 except showing a further embodiment of a merchandise display hook in accordance with the invention for fishing rods.

FIG. 9 shows a display hook 54 comparable to FIG. 5 except the elevated V-shaped bight 46 in FIG. 5 is replaced in this display hook 54 with an elevated ring hook 56 that forms closed loop.

Figure 10:
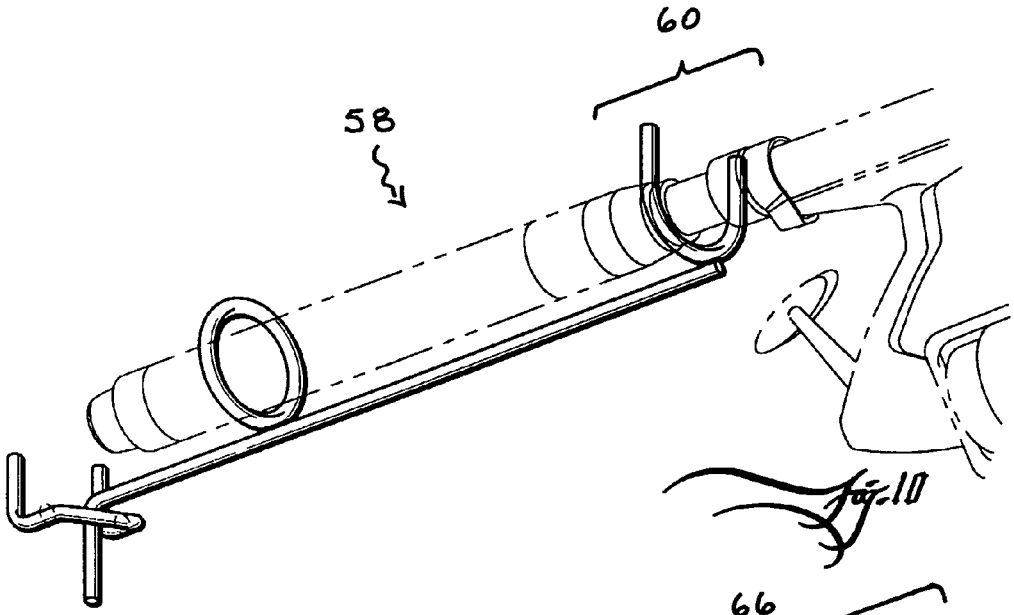
FIG. 10 is a perspective view comparable to FIG. 9 except showing still another embodiment of a merchandise display hook in accordance with the invention for fishing rods.

FIG. 10 shows a display hook 58 comparable to either FIG. 5 or 9 except the elevated V-shaped bight 46 in FIG. 5 is replaced in this display hook 58 with an elevated U-shaped bight 60 that has, naturally enough, a U-shape.

Figure 11:
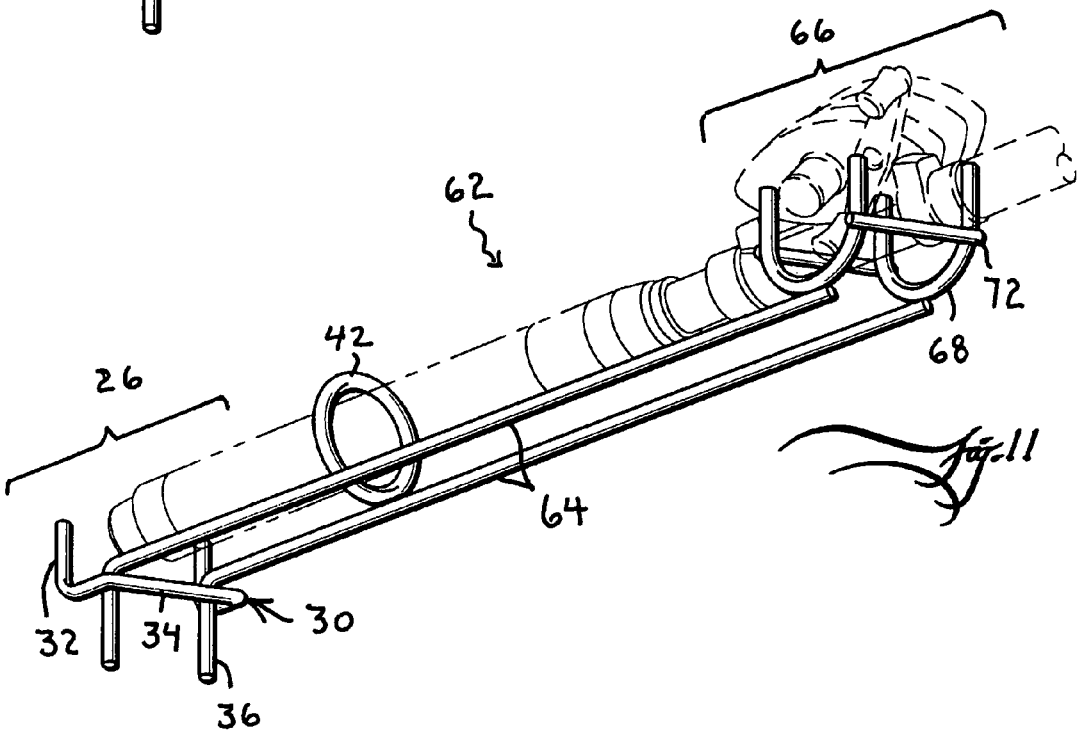
FIG. 11 is a perspective view of still a further embodiment of a merchandise display hook in accordance with the invention for fishing rods.

FIG. 11 shows still a further embodiment of a merchandise display hook 62 in accordance with the invention for fishing rods. This display hook 62 has parallel main shaft sections 64 extending together between an origin or hanger formation 26 and a terminal or hook formation 66. The hanger formation 26 is completed with the welding or fusing together of the L-shaped prong construction 30 shown in FIG. 2, which has a pair of L-shaped pegs 32 that project squarely from a crosspiece 34. Each of the main shaft sections 64 originate in a transition from downwardly depending stop sections 36. The L-shaped prong construction 30 is fused to the transitions between the main shaft sections 64 and the stop sections 36 as shown.

The parallel main shaft sections 64 cooperatively support an elevated hook formation 66 which is essentially a bight assembly. This elevated bight assembly 66 forms a reel cradle. The assembly 66 comprises a pair of U-shaped rods 68 in opposite left and right flanking positions fixed together by a pair of cross rods 72. Unlike the sole U-shaped bight 60 of FIG. 10, the opposite left and right U-shaped rods 68 are contained in vertical planes parallel to the axes of the main shaft sections 64. In the particular arrangement shown in FIG. 11, the left-side set of the U-shaped rods 68 and main shaft sections 64 are coplanar with one another as are their right-side counterparts. The parallel main shaft sections 64 carry a single and elevated retaining ring 42 as shown. Like the previous embodiments, the retaining ring 42 is oriented in a plane that cuts transversely across the axes of the main shafts 64.

In use, the elevated bight assembly 66 that forms a reel cradle as shown by FIG. 11 carries in cradle-like fashion a top-mounted reel like a bait-casting reel (as shown) or spin-cast reel. Accordingly, this display hook 74 in accordance with the invention is more particularly suited to showcasing bait-casting rods that have bait-casting or spin-cast reels mounted on them for display purposes. To contrast the previous embodiments, the previous embodiments are satisfactory for displaying any type of rod without a reel, including spinning and fly rods, but otherwise are more preferred for displaying spinning rods only when mounted with their matched spinning reels (as illustrated, eg., in FIG. 10 among other views).

Pause can be taken now to transition to a new series of embodiments of merchandise display hooks in accordance with the invention. The previous embodiments all are disclosed in connection with being entirely metal rod constructions. In contrast, the following embodiments replace one or more aspects of the previous embodiments with plastic or at least clip-on counterparts. The clip-on counterparts not only offer economies of cost but also offer some adjustability of the position of the clip-on aspects.

Figure 12:
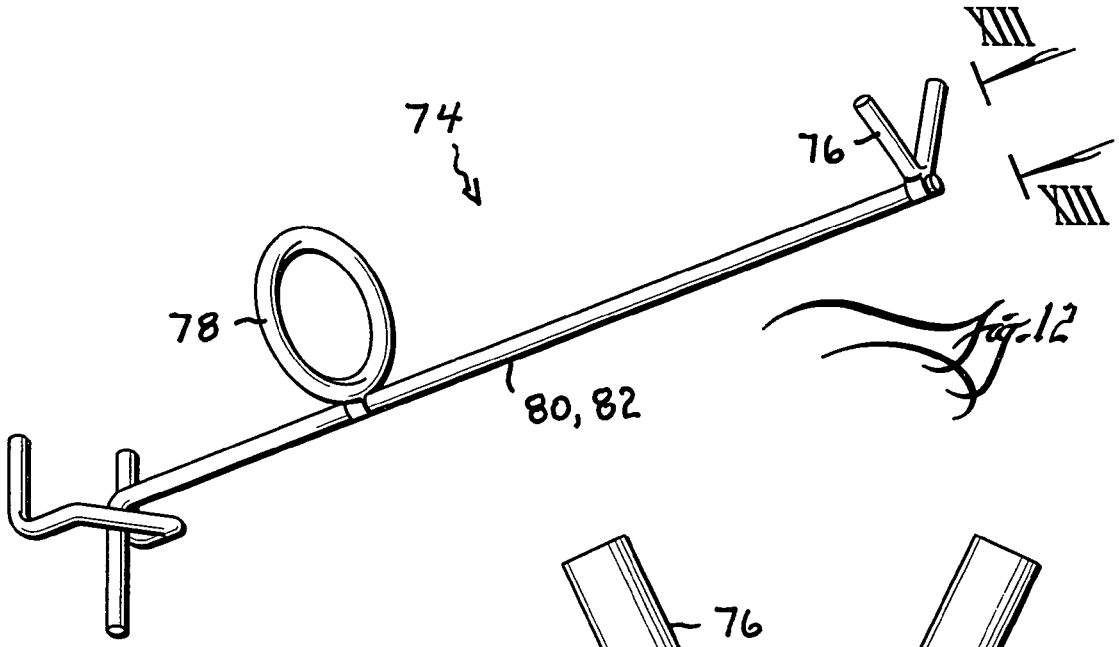
FIG. 12 is a perspective view of the FIG. 5 embodiment except showing an alternate version thereof.

FIG. 12 shows a display hook 74 comparable to the FIG. 5 embodiment except showing both a clip-on elevated V-shaped bight 76 as well as a clip-on elevated retaining ring 78. It is preferred if the clip-on bight 76 and retaining ring 78 are produced of plastic but not to the exclusion of any other suitable material.

Figure 13:
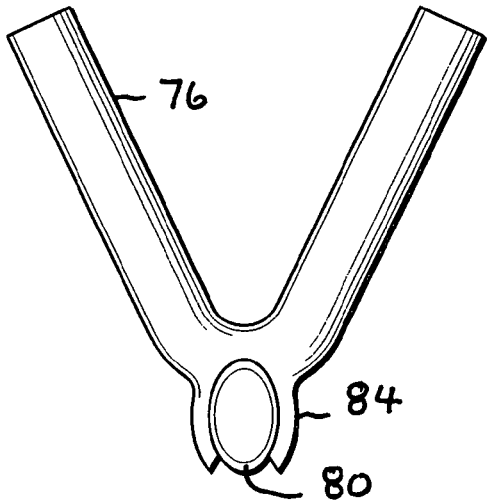
FIG. 13 is an enlarged-scale perspective view taken in the direction of arrows XIII-XIII in FIG. 12.
Figure 14:
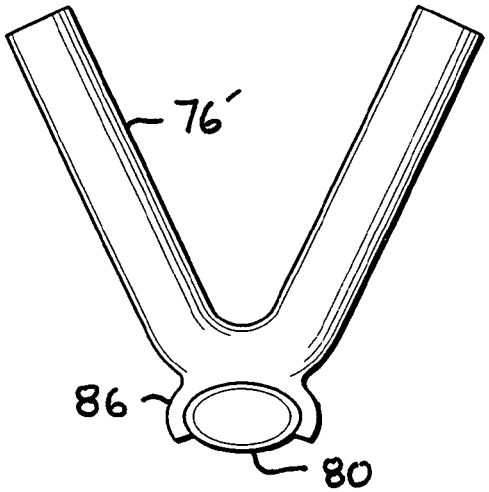
FIG. 14 is a perspective view comparable to FIG. 13 except showing an alternative arrangement of the hook bight thereof.

It is an aspect of the invention to prevent axial spinning of the clip-on attachments 76 and 78 about the axis of the main shaft 80 or 82. FIG. 13 shows that the main shaft 80 is not cylindrical but elliptical with the major axis oriented vertically. FIG. 14 shows a comparable elliptical main shaft 82 except the major axis is oriented horizontally. The elevated clip-on bights 76 of FIGS. 13 and 14 respectively have clip portions 84 and 86 oriented accordingly as shown.

Figure 15:
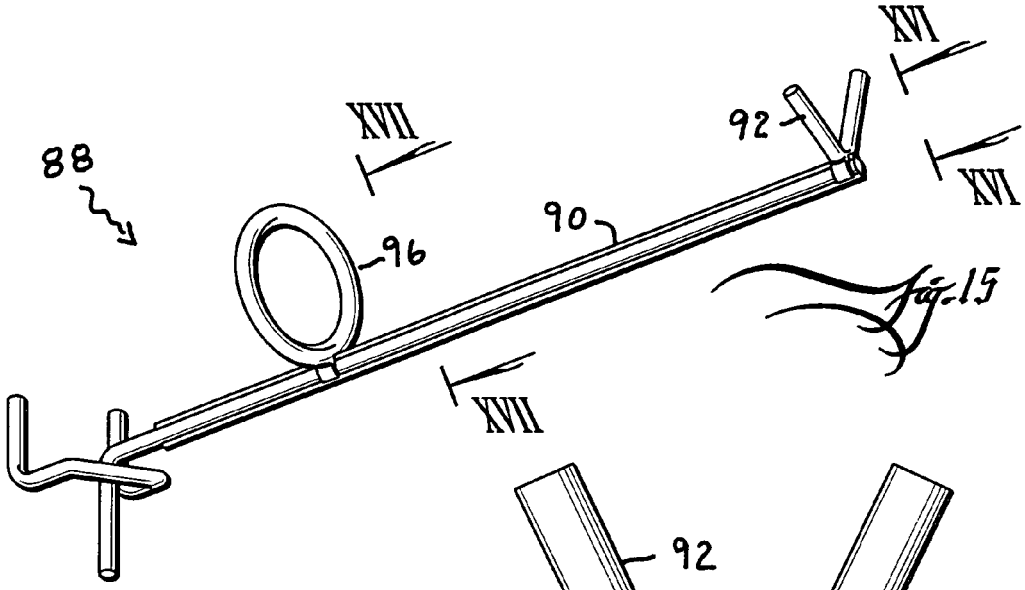
FIG. 15 is a perspective view of the FIG. 5 or 12 embodiment except showing an additional version thereof.
Figure 16:
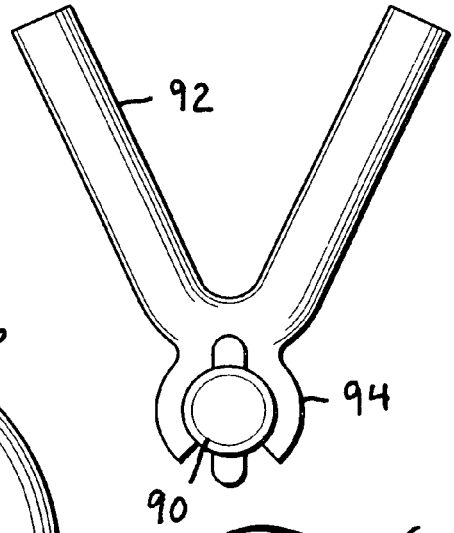
FIG. 16 is an enlarged-scale perspective view taken in the direction of arrows XVI-XVI in FIG. 15.
Figure 17:
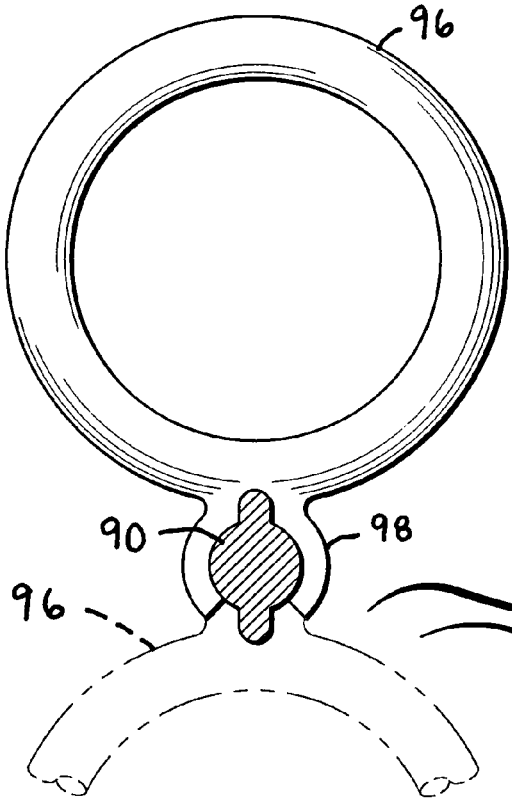
FIG. 17 is an enlarged-scale sectional view taken along line XVII-XVII in FIG. 15, wherein an alternate position for the retainer clip-on retainer is shown in broken lines.

FIG. 15 shows another solution to anti-spinning for a display hook 88 adapted for clip-on attachments. The main shaft 90 of the display 88 hook is produced with one or more splines. As better shown by FIGS. 16 and 17, this main shaft 90 has both a dorsal and ventral spline. The elevated clip-on bight 92 shown in FIG. 16 has a clip portion 94 configured accordingly as shown. FIG. 17 shows an elevated clip-on retainer 96 (in this instance, an elevated clip-on retaining ring) in accordance with the invention. This elevated clip-on retainer 96 likewise has a clip portion 98 configured accordingly, as for clipping onto the main shaft 90 of the FIG. 15 embodiment of the display hook 88. FIG. 17 furthermore shows that the clip-on retainer 96 can be positioned in an alternate disposition as is shown in broken lines, wherein in this alternate disposition it is not elevated but suspended.

Whereas the invention has been described in the foregoing as a merchandise display hook for fishing rods, it is not limited exclusively to displaying fishing rods in a retail setting. Indeed, among other end uses of the invention include displaying any rod-like or elongated merchandise including without limitation fish nets and fish gaffs.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

We claim:

1. A combination of retail shelves, a vertical support structure and a merchandise display hook for fishing rods having a butt portion terminating in a butt end; said combination comprising:

retail shelves occupying floor space and defining aisle space therefrom;

a vertical support structure above the retail shelves; and a display hook comprising an axial shaft extending from a fore end to an aft end; a bight formation affixed to or formed out of the axial shaft's fore end; a hanger fixture affixed to the axial shaft's aft end for hanging or arranging on the vertical support structure above the retail shelves, wherein the bight formation extends in a plane that is generally transverse to the shaft's axis for undergirding a fore section of the fishing rod's butt portion; and a retainer positioned on the shaft intermediate the hanger fixture and bight formation for partially surrounding a transverse top or bottom segment of an aft section of the fishing rod's butt portion between the fore section thereof and the butt end in order to stabilize the fishing rod when removably displayed by said display hook;

wherein the shaft projects from the hanger fixture horizontally as well as upwardly, and the bight formation and retainer are cooperatively arranged to cantilever the fishing rod from the butt portion thereof in an outwardly projecting upwardly inclined disposition in front of the vertical support structure, not only above the shelves thereby available for other merchandise at lower elevations, but also above aisle space;

whereby said combination provides retailers with an overhead presentation or display of fishing rods that is not only alluring to shoppers for being up high but also appealing to retailers for freeing up floor space.

2. The combination of claim 1 wherein the bight formation comprises a hook suspended under the shaft.

3. The combination of claim 1 wherein the shaft and the hook are formed from a monolithic single piece of material.

4. The combination of claim 3 wherein the retainer comprises an open ring generally having a C-shape that is suspended under as well as fused to the shaft and extends in a plane that is generally transverse to the shaft's axis.

5. The combination of claim 3 wherein the retainer comprises a closed ring that is suspended under as well as fused to the shaft and extends in a plane that is generally transverse to the shaft's axis.

6. The combination of claim 1 wherein the bight formation and retainer are suspended under the shaft and the retainer extends in a plane that is generally transverse to the shaft's axis and comprises either an upright bight portion or an inverted counterpart.

7. The combination of claim 1 wherein the bight formation and retainer are propped above the shaft and the retainer extends in a plane that is generally transverse to the shaft's axis and comprises either an upright bight portion or an inverted counterpart.

8. The combination of claim 1 wherein:

the shaft is formed from wire rod;

the wire rod shaft extends to a terminal transition, and the bight formation depends from the shaft at said transition and is an uninterrupted continuation of the same wire rod of the shaft except being formed to produce a hook shape.

9. The combination of claim 8 wherein the retainer comprises a wire rod open ring generally having a C-shape that is suspended by being fused or welded under the shaft and extends in a plane that is generally transverse to the shaft's axis.

10. The combination of claim 1 wherein:

the shaft is formed from wire rod;

the bight formation comprises a wire rod attachment for fusing or welding onto the shaft in an orientation to extend in a plane that is generally transverse to the shaft's axis.

11. A display hook for a fishing rods comprising:

a hanger fixture for hanging or arranging on a vertical support structure, a bight formation for undergirding a fore section of the rod's handle, and a wire rod shaft anchored in the hanger fixture and extending axially to the bight formation wherein the bight formation extends in a plane that is generally transverse to the shaft's axis; and a retainer attached to the shaft between the hanger fixture and bight formation for partially surrounding a transverse top or bottom segment of an aft section of the rod's handle between the fore section thereof and the rod's butt end in order to stabilize the rod when removably displayed by said display hook;

wherein the shaft projects from the hanger fixture generally horizontally and the bight formation and retainer are cooperatively arranged to cantilever the rod from the handle thereof in an outwardly projecting disposition; and wherein the bight formation comprises a clip-on attachment for clipping onto the shaft in an orientation to extend in a plane that is generally transverse to the shaft's axis.

12. The combination of claim 8 wherein the retainer comprises a wire rod closed ring that is suspended by being fused or welded under the shaft and extends in a plane that is generally transverse to the shaft's axis.

13. The combination of claim 8 wherein the retainer comprises a clip-on attachment for clipping onto the shaft in an orientation to extend in a plane that is generally transverse to the shaft's axis, said retainer further comprising either an upright bight portion or an inverted counterpart.

14. The display hook of claim 11 wherein the bight formation comprises a reel cradle for cradling a bait-casting reel mounted on the reel mount of the display rod.

15. The display hook of claim 11 wherein the shaft is non-cylindrical and the clip-on attachment's clip portion is formed to match in order to eliminate axial spinning of the clip-on attachment about the shaft's axis.

16. The display hook of claim 11 wherein the bight formation defines in part a channel portion, and which channel portion provides the undergirding support to the fore section of the rod's handle, wherein the channel portion is generally symmetric about a vertical plane of symmetry that also generally contains the shaft's axis so that the rod likewise is projected in generally the same plane in common with the shaft.

17. The combination of claim 1 further comprising:

a plurality of said display hooks, arranged in a row at one elevation above the shelves, whereby said plurality of display hooks display a plurality of fishing rods in form of an elevated, upwardly-inclined picket canopy above aisle space, with the rods inclined at a slight upward angle overhead standing shoppers so that the tip ends are not a hazard to passers-by while also allowing shoppers opportunity to walk in close underneath the butt ends and perform close inspection thereof.

* * * * *